United States Patent [19]

Ford et al.

[11] 4,001,450

[45] * Jan. 4, 1977

[54] METHOD OF PACKAGING CARBONATED BEVERAGES IN FLEXIBLE CONTAINERS

[75] Inventors: Andrew George Ford, Hitchin; Ronald Augustus Hudson, Welwyn Garden City, both of England

[73] Assignee: Imperial Chemical Industries Limited, London, England

[ * ] Notice: The portion of the term of this patent subsequent to July 10, 1990, has been disclaimed.

[22] Filed: Apr. 24, 1972

[21] Appl. No.: 246,992

Related U.S. Application Data

[63] Continuation-in-part of Ser. No. 749,500, Aug. 1, 1968, abandoned.

[30] Foreign Application Priority Data

Aug. 1, 1967 United Kingdom ..... 35334/67

[52] U.S. Cl. ..... 426/410; 53/22 B; 53/29

[51] Int. Cl.[2] ..... B65B 31/02

[58] Field of Search ..... 99/189, 171 B; 53/22 B, 53/22 A, 30, 37, 385, 386, 29; 141/5, 48, 313; 426/392, 397, 404, 410, 413, 106

[56] References Cited

UNITED STATES PATENTS

| | | | |
|---|---|---|---|
| 2,160,367 | 5/1939 | Maxfield | 206/DIG. 12 |
| 2,604,244 | 7/1952 | Tripp | 53/386 |
| 2,713,543 | 7/1955 | Peters | 53/22 B |
| 2,831,510 | 4/1958 | Carter | 53/386 X |
| 2,875,562 | 3/1959 | Mitchell | 53/22 B |
| 2,928,216 | 3/1960 | Orsini | 53/22 B |
| 2,938,314 | 5/1960 | Hopkins | 53/386 X |
| 3,063,845 | 11/1962 | Graves | 99/189 UX |
| 3,298,156 | 1/1967 | Lerner | 53/386 X |
| 3,307,319 | 3/1967 | Christensen et al. | 53/22 B |
| 3,381,446 | 5/1968 | Marchand | 53/385 |
| 3,382,642 | 5/1968 | Shaw | 53/22 B |
| 3,531,908 | 10/1970 | Rausing et al. | 53/37 |
| 3,590,888 | 7/1971 | Coleman | 141/313 X |
| 3,745,024 | 7/1973 | Ford et al. | 426/413 X |

*Primary Examiner*—Steven L. Weinstein
*Attorney, Agent, or Firm*—Cushman, Darby & Cushman

[57] ABSTRACT

Producing packages of carbonated beverages in plastics film containers by a method in which the container is brought to a fully inflated state before filling and maintained in such state during filling and sealing.

5 Claims, 8 Drawing Figures

Figures 1, 2, 3, 4, 5:
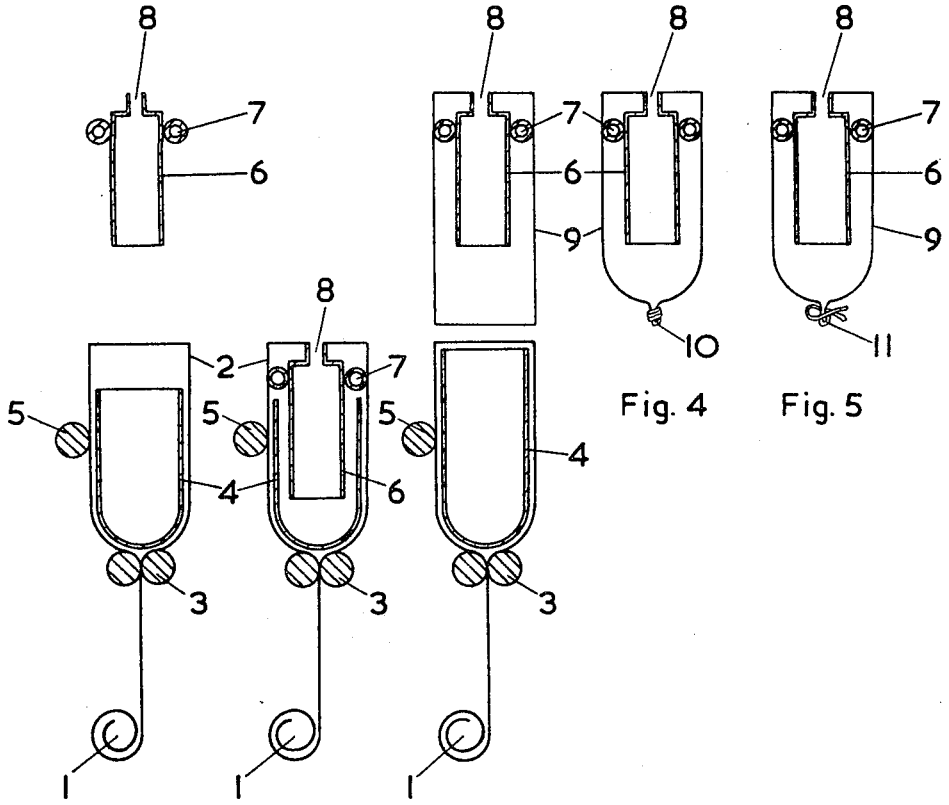

INVENTORS
ANDREW GEORGE FORD
RONALD AUGUSTUS HUDSON

By
Cushman, Darby & Cushman
ATTORNEYS

METHOD OF PACKAGING CARBONATED BEVERAGES IN FLEXIBLE CONTAINERS

This application is a continuation-in-part of our application, Ser. No. 749,500, filed on 1 Aug. 1968, now abandoned.

The present invention is concerned with a method of forming packages containing contents at superatmospheric pressure. More particularly, the invention is concerned with a method of filling plastics film containers with carbonated beverages and the like. The packaging of pressurized liquids such as beer and other carbonated beverages has conventionally been in glass bottles and cans. However, the art has long appreciated that the retailing of such pressurized liquids might be substantially improved if the containers could be made of an inexpensive, light-weight and shatter-resistant material, and one that could be easily destroyed.

Plastics film meets the requirements of such a material, but no method has been successfully devised for packaging a pressurized liquid, such as a carbonated beverage, in a plastics film, although many methods have been proposed. Major obstacles to using a plastics film for this purpose have been the difficulties in filling the flexible film with the pressurized liquid and then sealing the container to produce a tight, leak-proof pack. As can be easily appreciated, for carbonated beverages to be successfully packaged in plastics-film containers, the closing of those containers must provide a seal which will withstand the pressures exerted by the carbonated beverages not only during filling, but also during storage and transit.

It has previously been proposed, for example, to package a carbonated beverage by filling it into a tube of flexible plastics film and forming the filled tube into a succession of liquid-tight receptacles joined by the intervening tube collapsed into a neck portion or otherwise sealed. However, it has not been found possible to form a seal between the wet plastics surfaces, that will resist the pressure developed in the package.

In co-pending applications, there is disclosed a package for pressurized liquids, such as carbonated beverages, in which package the container is made of a plastics film in a tubular shape with each end of the tube sealed, bunched together and held closed by a ligature. A thickened region at each bunched neck, of greater cross-sectional area than the region encompassed by the ligature, substantially strengthens the seals at the bunched neck and prevents them from rupturing. The use of such separate containers provides substantial advantages, in that they may be individually filled and a sufficient gas space left for the closing seal to be made between dry plastics surfaces. However, it has been found that, even when the container is filled to leave a gas space of minimum size to allow for the container to be sealed, too large a gas bubble develops in the package upon warming up from the filling temperature. The creases at the ends of the tubular containers are not fully opened by weight of the liquid alone, and even the intermediate part of the container is less than a perfect cylinder until an internal superatmospheric pressure develops. The presence of large gas spaces containing the gas under pressure is not desirable, since the contents tend to go flat, and the gas escapes with a somewhat noisy explosion when the container is opened. Moreover, the use of a container that is only about half full means that space is wasted in transport and storage.

It is an object of the present invention to provide a method of forming such packages by which the volume of the gas spaced formed in the packages may be greatly reduced. Other objects will appear hereinafter.

In accordance with the present invention, a method of packaging a carbonated beverage comprises providing an individual plastics-film container closed by gas-tight seals except at a filling opening; pressurizing the container by introducing through said filling opening carbon dioxide to a pressure substantially equal to that desired at the same temperature in the final package; displacing a major part but less than the whole of the carbon dioxide in the container so inflated with the carbonated beverage to be packaged; maintaining substantially in such inflated state at least that part of the container that has been filled with carbonated beverage, by the continued application of differential pressures to the inner and outer surfaces of the container walls; and, while the container is in substantially such inflated state, closing the filling opening over the gas space by a gas-tight seal.

The fact that the container is not only inflated, before filling, to substantially its final size, but is prevented from relaxing at any time thereafter until it has been sealed, will allow a very substantial reduction in the volume of the gas space in the final pack.

In one embodiment of the method of the invention, the plastics container is placed in an open-mouthed mould or the like having a cavity corresponding in shape to, and only marginally smaller than, the container when fully inflated, and the walls of the container are brought into contact with the mould when the container is pressurized with carbon dioxide, and remain in such contact during filling. The mould or the like is porous (or perforated or channelled) and the container walls, having been brought into contact with the mould, may be held in contact with it by a vacuum action through the walls while the filling opening is being sealed.

It will be appreciated that, in order to allow the container to be held with certainty by the vacuum, the mould must be marginally smaller than the fully inflated container. At the pressures of inflation, however, the difference is negligible compared with the difference in volume between the inflated and the relaxed container. The container may thus be regarded as being substantially in its fully inflated state.

One such form of the method of the invention will now be described by way of example with reference to the accompanying drawings, which show diagrammatically stages in a continuous process for the production of packages of a carbonated beverage.

In FIG. 1 is shown a reel, 1, of plastics tubular film, from which the film, 2, is drawn through a pair of nip rolls, 3, and around a hollow open-ended internal former, 4. This former, supported by the nip rolls, floats freely within the tubular film and is held in the vertical position by three rolls spaced around it, one shown at 5. The film is initially drawn by hand into the position shown in FIG. 1. Vertically above the hollow former is a hollow open-ended mandrel, 6, which carries around its circumference at its upper end an inflatable ring, 7, connected to sources of vacuum and pressure. The mandrel interior is connected, through the tube, 8, to a source of carbon dioxide under pressure. With the tubular film in the position shown in FIG. 1, the mandrel 6 is moved vertically downwards, as shown in FIG. 2, a vacuum being applied to the inflatable ring so that the mandrel assembly can be inserted into the open tubular film. The vacuum is now released from the inflatable ring and gas under pressure supplied. This inflates the ring so that the tubular film is firmly gripped internally around its circumference. The mandrel is then raised, as shown in FIG. 3, drawing film with it. The film is cut as shown so that a container blank, 9, is formed and the leading end of the remaining film is in a position where the cycle can be repeated.

The mandrel, with the film firmly attached, is now moved to an operational station where the end of the container blank is turned over and heat sealed at 10, as shown in side view in FIG. 4, and then to a second station where a ligature, 11, is applied, as shown in FIG. 5. The mandrel assists in the sealing and ligaturing operations by locating the film and supporting the body of the container in tubular shape, so that uniform bunching of the end is obtained.

Figures 6, 7, 8:
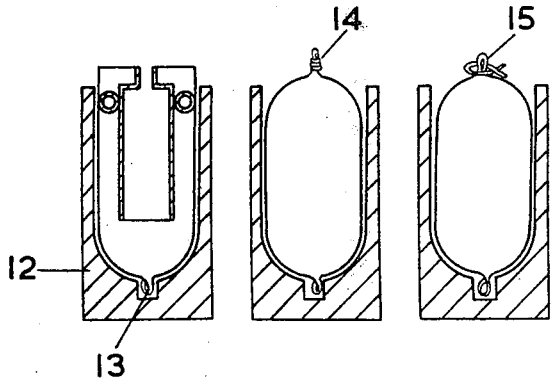

The mandrel, with the partly formed container, is now inserted into a mould, 12, suitably a porous metal pot, to the walls of which a vacuum can be applied, as shown in FIG. 6. The mould is shaped so that it is only marginally smaller than the container when inflated at the working pressure. There is, however, a recess, 13, at the bottom to take the sealed and ligatured projecting end of the container. Carbon dioxide pressure is now applied through the top of the mandrel, and a vacuum to the walls of the mould, so that the container is inflated into contact with, and held against, the walls of the mould. The gas is prevented from escaping by the inflated tube around the mandrel. Chilled carbonated drink is now filled also through the top of the mandrel into the container, the carbon dixode being displaced. The carbon dioxide is supplied from, and returned to, the top of the reservoir from which the liquid is supplied. When the container has been sufficiently filled the gas and liquid valves are closed, a vacuum is maintained in the wall of the mould, the gas pressure on the mandrel ring is released, and the mandrel assembly is withdrawn. The vacuum through the mould holds the filled container firmly in contact with the mould.

The mould, with the filled container and with the vacuum maintained, is now moved to a station at which the top of the film is turned over and heat sealed at 14, as shown in FIG. 7, and then to a second station, FIG. 8, where a ligature, 15, is applied. The vacuum on the mould is now released, enabling the filled, complete container to be removed.

Various modifications may be made in the method particularly described. For example, the mould, instead of being a porous pot, may be formed of a mesh surrounded by a space that may be evacuated, or may be channelled to allow a vacuum to be applied. The inflatable ring may be replaced by a different means for gripping the film around its circumference, such as, for example, external clamps to clamp the film against a soft rubber ring fixed around the mandrel.

In producing, by the method of the invention, filled containers each containing a standard quantity of carbonated beverage the size of container required is considerably reduced compared with the size required when filling a container in a limp condition, and the gas bubble that develops as the liquid warms is thus much reduced. The method thus gives great advantages in the packaging of beer and other carbonated liquids.

Types of plastics-film containers other than that particularly described may be used provided that they are of sufficient strength, and are formed with gas-tight seals.

The nature of the plastics material forming the containers will be chosen in accordance with the intended pressure to be enclosed or developed within the pack. For high pressures such as those exceeding 15 p.s.i. pouches formed of biaxially oriented polyethylene terephthalate film are especially suitable, particularly when coated with a heat-sealable, gas-impermeable coating, for example a coating of vinylidene chloride copolymer.

The containers may be enclosed in cartons, or otherwise provided with free standing supports, if desired.

We claim:

1. A method of packaging a carbonated beverage that comprises the steps of: passing a length of flexible plastics film in tubular form upwards over an internal former which opens the tubular film; drawing the film from the former by a gripping and sealing means inserted downwardly into the open end of the tubular film and there operated to grip and seal the tubular film against it around its circumference, and then moved away from the former; cutting the tubular film transversely to leave the length required for a container suspended on the gripping and sealing means; sealing the cut end of the tubular film to close the bottom thereof and form a container; inserting the container, still held by the gripping and sealing means, into an open-mouthed mould having a cavity corresponding in shape to, and only marginally smaller than, the container when fully inflated and inflating the container into contact with the walls of the mould by introducing carbon dioxide through the gripping and sealing means to a predetermined pressure; applying a vacuum to the walls of the mould to hold the container in contact with the walls of the mould; displacing a major part but not the whole of the carbon dixoide in the container with a carbonated beverage; and, while maintaining the vacuum to hold the container in contact with the walls of the mould, releasing the gripping and sealing means and closing the open end of the container by a gas-tight seal.

2. A method as claimed in claim 1 in which the gripping and sealing means is an inflatable ring, inserted into the tubular film while deflated, and inflated into tight gripping and sealing contact with the internal surface of the tubular film around its circumference, and in which the container is inflated by pressure applied through the middle of the ring.

3. A method of packaging a carbonated beverage that comprises providing an individual, flexible, tubular plastics-film container closed in a gas-tight manner except at a filling opening, inflating the container by means of carbon dioxide supplied through said filling opening to a pressure such that the container attains substantially the size desired in the final package, filling the container by displacing a major part but less than the whole of the carbon dioxide therein with the carbonated beverage to be packed supplied through said opening, and sealing the filling opening of the container, both the filling and the sealing being carried out while at least the major part of the container is kept substantially at its final size, and relaxation of the walls thereof is prevented, by continuously maintaining a greater pressure inside the container than outside the walls thereof until sealing has been completed, the prevention of relaxation of said walls during filling and sealing enabling a full charge of beverage to be supplied to the container while leaving a gas space adjacent said filling opening whereby the seal can be made between dry plastics surfaces.

4. A method as claimed in claim 3 in which the container is inflated into contact with an open-mouthed mould having a cavity corresponding in shape to, and only marginally smaller than, the container when fully inflated.

5. A method as claimed in claim 4 in which the container is inflated into contact with the walls of the mould by the carbon dioxide and is subsequently maintained in such contact by a vacuum applied through the walls of the mould.

* * * * *